US005172344A

United States Patent [19]

Ehrlich

[11] Patent Number: 5,172,344

[45] Date of Patent: Dec. 15, 1992

[54] DEEP SUBMERGENCE TRANSDUCER

[75] Inventor: Stanley L. Ehrlich, Middletown, R.I.

[73] Assignee: Raytheon Company, Lexington, Mass.

[21] Appl. No.: 374,860

[22] Filed: Jun. 29, 1973

[51] Int. Cl.[5] ..... H04R 17/00

[52] U.S. Cl. ..... 367/152; 310/325; 310/337; 367/157; 367/162; 367/167

[58] Field of Search ..... 340/8, 8 PC, 8 MM, 70, 340/9, 11, 12, 13, 14; 310/8.2, 8.3, 8.7, 337, 325; 367/152, 157, 158, 159, 162, 167, 172, 176

[56] References Cited

U.S. PATENT DOCUMENTS

| | | | |
|---|---|---|---|
| 2,473,971 | 6/1949 | Ross | 340/9 UX |
| 3,284,761 | 11/1966 | Douglas | 340/10 |
| 3,328,751 | 6/1967 | Massa | 340/10 |
| 3,337,842 | 8/1967 | Bouyoucos | 340/8 R |
| 3,541,502 | 11/1970 | Behrendt et al. | 340/10 X |
| 3,663,933 | 5/1972 | Madison | 340/10 |

*Primary Examiner*—Harold J. Tudor

*Attorney, Agent, or Firm*—Judith A. Caplan; Richard M. Sharkansky

[57] ABSTRACT

A transducer assembly providing a conversion between the electrical and sonic energy, the transducer assembly being adapted for operating submerged at great depths in ocean waters. The transducer assembly is formed by a front and back plate which are affixed in one embodiment to the ends of a first mechanically distributed impedance member, a second mechanically distributed impedance member located between the front and the back plate and a transducer of electroacoustical material mechanically coupling the first and second members for imparting sonic vibrations to these members. In a preferred embodiment, the transducer is bonded at one end thereof to the back plate and at the other end thereof to the second member. External hydrostatic pressure present at the front and back plates does not compress the electroacoustical material.

4 Claims, 2 Drawing Sheets

DEEP SUBMERGENCE TRANSDUCER

BACKGROUND OF THE INVENTION

It is desirable in certain applications to have a transducer assembly which can operate at great depths in the ocean without permitting external stresses due to hydrostatic pressure to be applied to the ceramic material of a transducer since such stresses change its electrical properties with an attendant detuning and/or degrading of the transducer. While various forms of transducer assemblies have been provided in the prior art, some of these having ports for allowing the flow of fluid into the transducer assembly to equalize the inner and outer pressures, the electro-acoustical material of the transducer is, nevertheless, subjected to the external pressures. While a transducer circuit can be designed for use with a transducer subjected to intense pressures, a change in the pressure as occurs with a changing depth of operation of the transducer assembly results in a detuning and/or degrading of the transducer.

SUMMARY OF THE INVENTION

The aforementioned problems are overcome and other advantages are provided by a transducer assembly in accordance with the invention which isolates the electroacoustical material of the transducer from external pressures. The transducer assembly is composed of first and second members which serve as the front end and the back end of the transducer assembly, a third member which can vibrate over a band of frequencies which are to be transmitted or received by the transducer assembly, the third member being positioned between and affixed to the first and the second members, and a fourth member which can vibrate over the same band of frequencies and is positioned, in a preferred embodiment, between the first and second members without contacting the first and second members. The transducer assembly also contains a transducer, typically composed of a piezoelectric ceramic material, which is mechanically coupled between the third and fourth members for inducing sonic vibrations therein when excited by an electrical signal. While this transducer assembly is primarily adapted to transmit sonic energy, it can also be utilized for receiving sonic energies since sonic vibrations set up within the third and fourth members induce an electrical signal at the terminals of the transducer. During a condition of resonance the third and fourth members are vibrating. The second member, which serves as the back plate, may experience little or no vibration and thus may be regarded as being in a nodal region. In a preferred embodiment of the invention, the transducer is bonded at one end thereof to the back plate and at its other end to the fourth member. Prestressing rods may also be utilized between the fourth member and the back plate for putting a bias pressure on the ceramic material. The components of the transducer assembly are conveniently enclosed by means of an outer case which is resiliently mounted to the front plate.

BRIEF DESCRIPTION OF THE DRAWINGS

The aforementioned aspects and other features of the invention are explained in the following description taken in connection with the accompanying figures wherein.

DESCRIPTION OF THE PREFERRED EMBODIMENT

Figure 1:
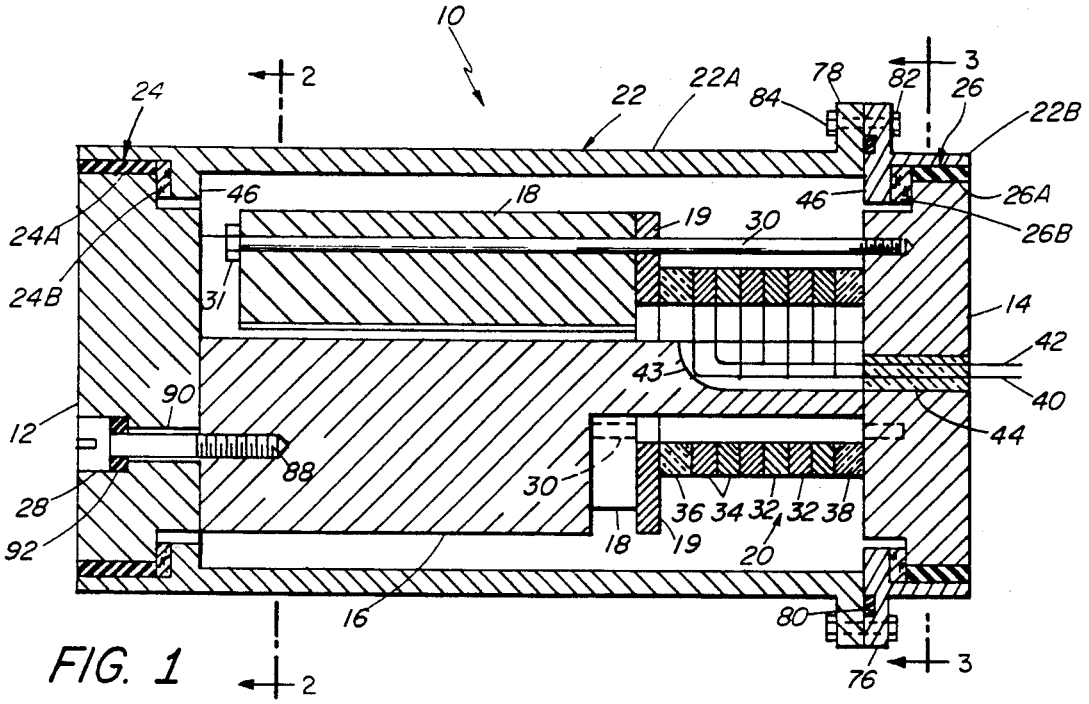
FIG. 1 is a sectional view taken along a longitudinal axis of the transducer assembly of the invention.
Figure 2:
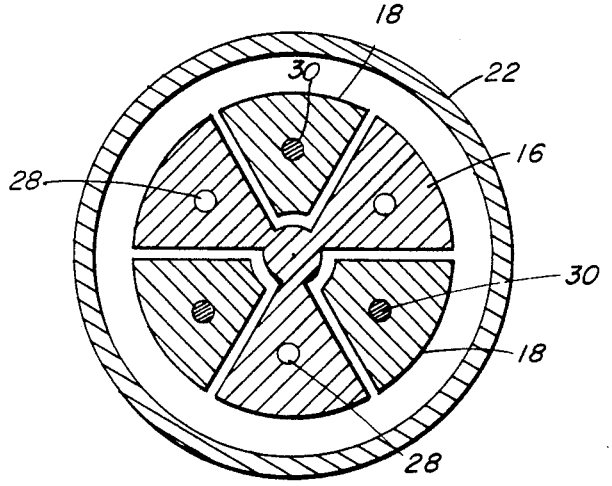
FIGS. 2 and 3 are transverse sectional views of the transducer assembly of FIG. 1 taken along the lines, respectively, 2—2 and 3—3.
Figure 3:
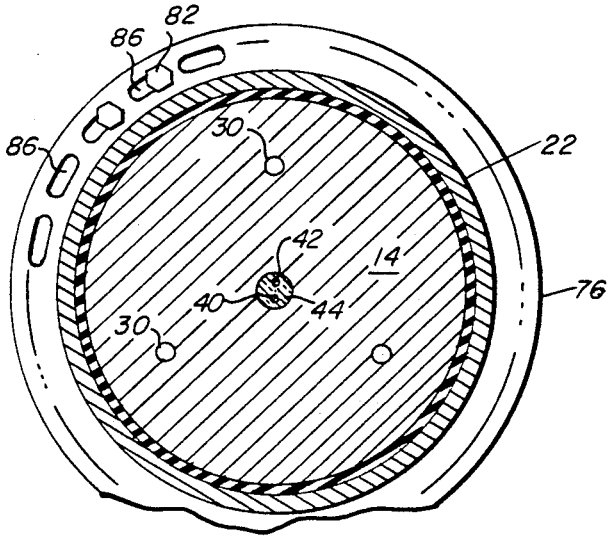

Referring now to FIGS. 1-3, there is shown a transducer assembly 10 which, in accordance with the invention, comprises a front plate 12, a back plate 14, a frame 16, three resonator segments 18 affixed to a ring 19 which encircles a portion of the frame 16 having a reduced cross section, a transducer 20, a case 22 and mounts 24 and 26. Three screws 28 secure the front plate 12 to the frame 16. Three rods 30 are coupled from the back plate 14 to the ring 19 and the resonator segments 18 to which they are secured by nuts 31 for prestressing the transducer 20. The transducer 20 preferably comprises an even number of rings 32 of ceramic material, such as lead zirconate titanate or any of a similar class of piezoelectric materials commonly used in sonar applications, each of the rings having metallic electrodes 34 which are bonded thereto as by firing. Insulating rings 36 and 38, which may be of a ceramic or phenolic material, are affixed at the ends of the array of rings 32. The rings 32 with their electrodes 34 and the insulating rings 36 and 38 are all bonded together in a manner well known to the sonar art. Circumferential prestressing of the rings 32 may be provided by winding fiberglass or similar threadlike material (not shown) under tension around the rings 32. The insulating rings 36 and 38 are bonded respectively to the ring 19 and the back plate 14. One electrical wire 40 is connected to the first, third, fifth and seventh ones of the electrodes 34 while a second electrical wire 42 is coupled to the second, fourth and sixth ones of the electrodes 34. The electrical wires 40 and 42 are passed via a channel 43 in the frame 16 and are brought out from the transducer assembly 10 via a plug 44 in the back plate 14, the plug 44 being impervious to an external fluid into which the transducer assembly 10 may be submerged. If desired, a tuning coil may be inserted in a rubber boot, not shown, affixed to the back plate 14 around the wires 40 and 42.

The resonator segments 18 and ring 19 may be fabricated, by way of example, from steel, brass or bronze, while the frame 16 may be fabricated from steel. The front plate 12 is fabricated preferably from a lighter metal, such as titanium, aluminum or magnesium, to provide a rigid structure without excessive weight. The mounts 24 and 26 comprise rubber gaskets, respectively, 24A and 26A, for excluding sea water from within the case 22 and are terminated on their inner sides by gaskets, respectively, 24B and 26B, of a vibration insulating material such as a cork-neoprene compound or Kraft paper. The gaskets 24B and 26B abut against bezels 46 of the case 22.

In operation, the transducer 20 is made to vibrate by electrical signals passing through the plug 44 on the wires 40 and 42. The wires 40 and 42 are typically coupled, in a manner well known in the sonar art, via an external cable (not shown) to a generator of electrical signals located at a distance from the transducer assembly 10. For example, such a signal generator may be mounted within a ship traveling along the ocean while the transducer assembly 10 is supported beneath the ship in a well-known manner by means of a long cable. The vibrations of the transducer 20 are manifested by a contraction and expansion of the transducer 20 along the axis of the transducer assembly 10 with the result that the back plate 14 and the resonator segments 18 are drawn alternately towards each other and away from each other. Depending on the stiffness of the frame 16, the resonator segments 18, and the masses of the front plate 12 and the back plate 14, various modes of vibration can be accomplished. For example, if at the frequency of vibration of the transducer 20, the mechanical impedance of the resonator segments 18 and ring 19 is equal to the complex conjugate of the combined mechanical impedance of the front plate 12, the back plate 14 and the frame 16, then it is apparent that a node of vibration would appear at approximately the midpoint of the transducer 20 with the resonator segments 18 moving to the right while the front plate 12 and the back plate 14 move simultaneously to the left, and vice versa. If the frame 16 and the resonator segments 18 are provided with a structural configuration such that at the frequency of vibration of the transducer assembly 10, the mechanical impedance of the resonator segments 18, the ring 19 and the transducer 20 is equal to the combined mechanical impedance of the front plate 12, the back plate 14 and the frame 16, then, a node of vibration appears at the back plate 14 while maximum amplitudes of vibration appear at the front plate 12 and at the front end of the resonator segments 18. Due to the location of the node of vibration at the back plate 14, the mount 26 may be deleted and the transducer assembly altered slightly to permit the back plate to be bolted on in a manner such as that to be seen in FIG. 4. In this latter mode of operation, it is seen that the transducer assembly 10 radiates outwardly from the front plate 12 while substantially no radiation is being produced at the back plate 14. In this way, the transducer assembly 10 can be provided, for example, with radiation characteristics approximating those of an acoustic monopole or an acoustic dipole.

Figure 4:
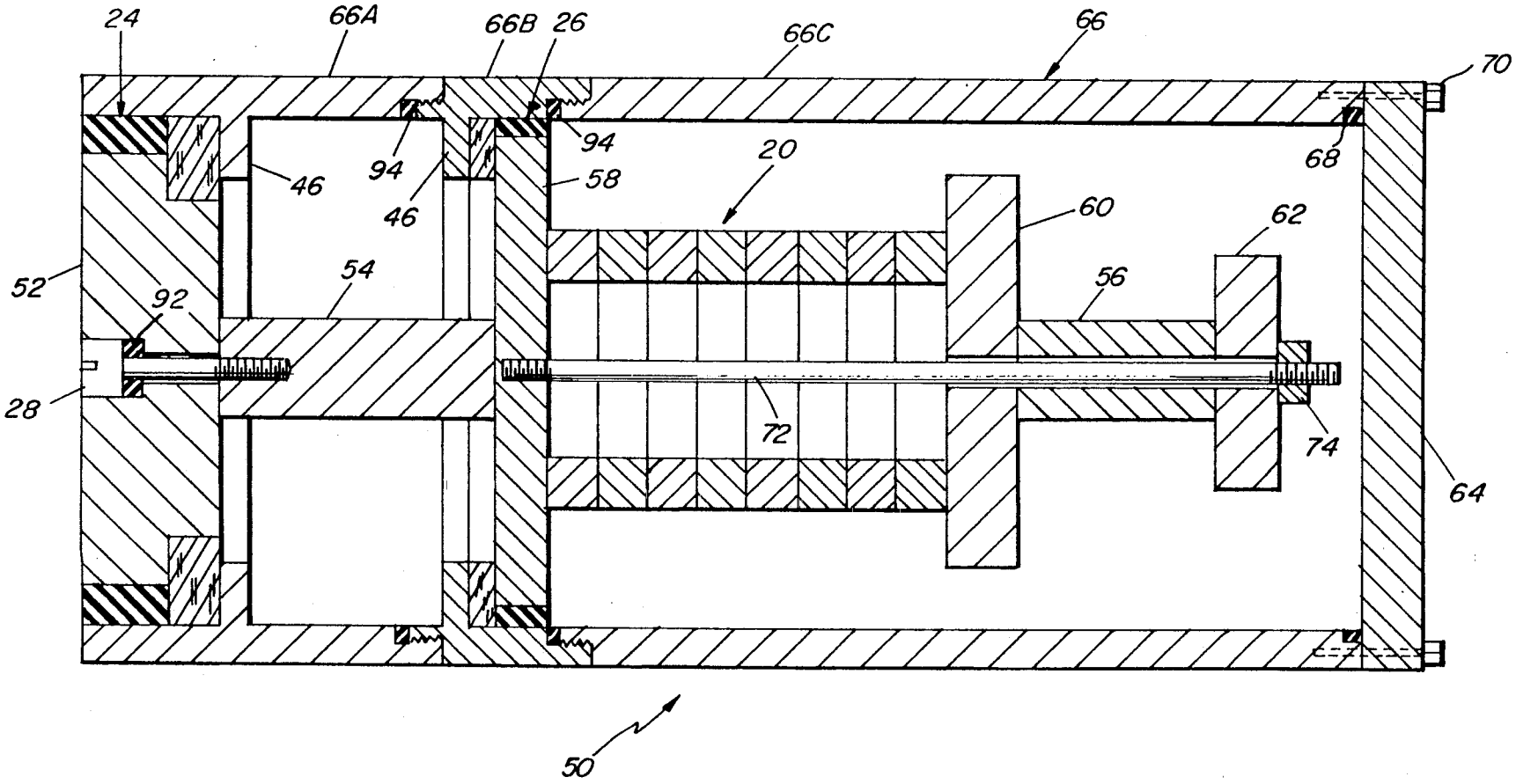
FIG. 4 is a sectional view taken along a longitudinal axis of an alternative embodiment of the transducer assembly.

Referring now to FIG. 4, there is seen an alternative embodiment of the invention in which a transducer assembly 50 comprises a front plate 52, longitudinal members 54 and 56, plates 58 and 60, rear mass 62, back plate 64 and case 66. The case 66 comprises bezels 46 as did the embodiment of FIG. 1, and the front plate 52 is joined to the case 66 by means of the mount 24 which was also previously seen in FIG. 1. The front plate 52 is rigidly connected to the plate 58 by the longitudinal member 54, and the plate 60 is rigidly connected to the rear mass 62 by the longitudinal member 56. The plates 58 and 60 are mechanically coupled via the transducer 20 which was previously seen in FIG. 1. The transducer 20 is energized via electrical signals conveyed via electrical wires (not shown in FIG. 4) as was disclosed with reference to FIG. 1. The plate 58 is held against the bezel 46 by means of a mount 26 which was previously seen in FIG. 1. The back plate 64 is forced against a gasket 68 and retained in position at the end of the case 66 by means of bolts 70 which are threaded into the case 66. Also a tie rod 72 is threaded into the plate 58 and passes through the centers of the transducer 20, plate 60, member 56 and rear mass 62 to which it is secured by a nut 74 for prestressing the ceramic material of the transducer 20.

In operation, the transducer assembly 50 provides a vibration of the front plate 52 in response to excitation of the transducer 20 in a manner analogous to that previously disclosed with reference to FIG. 1. Thus, where the combined mechanical impedance of the front plate 52, the longitudinal member 54 and the plate 58 is equal to the combined mechanical impedance of the plate 60, the longitudinal member 56 and the rear mass 62, a vibration node appears at approximately the midpoint of the transducer 20. By varying the configurations of these elements with the attendant change in mechanical impedance, the node of vibration may be shifted in a well-known manner to a point within the plate 58 so that the plate 58 is substantially motionless and the other elements of the mechanical system vibrate in response to the excitation by the transducer 20. Here, too, the transducer 20 is protected from external hydrostatic pressure since an external fluid in which the transducer assembly 50 may be submerged is prevented from entering the region of the case 66 enclosing the transducer 20 by virtue of the gasket 68 and mount 24. If desired, the plate 60, longitudinal member 56 and rear mass 62 may be combined into a single mass element, not shown, which can have the conjugate impedance of the compliance of the transducer 20 at the desired frequency of vibration. In these embodiments, the various mechanical elements have simpler shapes than is the case with the embodiment of FIG. 1, however, the embodiment of FIG. 4 is not as compact as that of FIG. 1.

Referring now to FIGS. 1 and 4, it is seen that the cases 22 and 66 are divided into sections to permit easy fabrication of the transducer assemblies 10 and 50, the case 22 being divided into sections 22A and 22B, and the case 66 being divided into sections 66A, 66B and 66C. In fabricating the transducer assembly 10, the front plate 12 is positioned with respect to the case section 22A and then the material of the mount 24 is forced in between the front plate 12 and the case section 22A under pressure and in an environment of elevated temperature to provide for a vulcanization of the mount 24 to the front plate 12 and the case section 22A. The same procedure is then followed with respect to the mount 26, the back plate 14 and the case section 22B. The same procedure is also utilized in fabricating the transducer assembly 50 with respect to joining the front plate 52 to the case section 66A via the mount 24 and the joining of the plate 58 to the case section 66B via the mount 26. Since the vulcanization of the mounts 24 and 26 involves the use of elevated temperatures, it is desirable to accomplish this vulcanization at the beginning of the fabrication so that the other elements of the transducer assemblies 10 and 50, such as the transducer 20, are not subjected to the elevated temperatures.

With respect to the transducer assembly 10, the fabrication continues by bonding the transducer 20 to the back plate 14, and then connecting the frame 16, the resonator segments 18 and the ring 19 to the transducer 20. The frame 16, the ring 19, the resonator segments 18 and the transducer 20 are then inserted into the case section 22A and a flange 76 of the case section 22B is butted against a flange 78 of the case section 22A. The flange 76 carries a rubber grommet 80 which is compressed between the two flanges 76 and 78 to exclude the entry of water from the interior of the case 22 upon submergence of the transducer assembly 10 in the ocean. The two flanges 76 and 78 are joined together and the grommet 80 is compressed by means of a plurality of bolts 82 and nuts 84 affixed thereto and secured via slots 86 arranged circumferentially around the flange 76 and also around the flange 78, the slots 86 and two of the bolts 82 being seen in FIG. 3. The use of the slots 86 permits an angular adjustment about the axis of the case 22 of the case section 22A relative to the position of the case section 22B. Finally, the front plate 12 is rigidly connected to the frame 16 by means of the screws 28. To permit insertion of the screws 28, threaded holes 88 of the frame member 16 are aligned through holes 90 of the front plate 12 by rotating the case 22A about its axis relative to the case section 22B. A water tight seal in the form of a rubber ring 92 is provided around the shaft of the screw 28 and compressed between the head of the screw 28 and the front plate 12 to prevent the seepage of water past the screw 28.

A fabrication of the transducer assembly 50 proceeds in an analogous fashion. After a vulcanization of the mounts 24 and 26, the plate 58 is bonded or welded to the longitudinal member 54 and is also bonded to the transducer assembly 20. The plate 60, the longitudinal member 56 and the rear mass 62 are then coupled to the transducer 20 and the plate 58 by the tie rod 72. The case section 66A is provided with a grommet 94 and then is threadedly secured to the case section 66B, the grommet 94 being compressed upon the joining of the section 66A with the section 66B for excluding the entry of sea water to the interior of the case 66. The front plate 52 is rigidly secured to the longitudinal member 54 by a screw 28 and ring 92 as was done with the transducer assembly 10. Finally, the case section 66C is threadedly secured to the case section 66B with the aid of a grommet 94, and the back plate 64 is secured to the case section 66C.

It is understood that the above-described embodiments of the invention are illustrative only and that modifications thereof will occur to those skilled in the art. Accordingly, it is desired that this invention is not to be limited to the embodiments disclosed herein but is to be limited only as defined by the appended claims.

What is claimed is:

1. A transducer assembly capable of radiating sonic energy while being submerged within a medium exerting hydrostatic pressure thereupon, said transducer assembly comprising:

a front plate and a back plate;

a frame interposed between said front plate and said back plate for urging said front plate and said back plate apart against said hydrostatic pressure;

a resonator interposed between said front plate and said back plate; and means positioned between said front plate and said back plate and coupled between said back plate and said resonator for vibrating said resonator relative to said back plate.

2. A transducer assembly according to claim 1 wherein the combined mechanical impedance of said resonator and said vibrating means at a frequency of said vibrating is equal to the combined mechanical impedance of said front plate, said back plate and said frame at said frequency.

3. A transducer assembly capable of radiating sonic energy while being submerged within a medium exerting hydrostatic pressure thereupon, said transducer assembly comprising:

a front plate and a back plate;

a frame interposed between said front plate and said back plate for urging said front plate and said back plate apart against said hydrostatic pressure;

a resonator;

means coupled between said back plate and said resonator for vibrating said resonator relative to said back plate; and wherein the combined mechanical impedance of said resonator and said vibrating means at a frequency of said vibrating is equal to the combined mechanical impedance of said front plate, said back plate and said frame at said frequency; and wherein said frame includes a plurality of longitudinal voids symmetrically positioned about a longitudinal axis, and wherein said resonator comprises a plurality of resonator sections positioned respectively in individual ones of said voids.

4. A transducer assembly according to claim 3 further comprising means coupled between said resonators and said back plate for prestressing said vibrating means.

* * * * *